US011835215B2

(12) United States Patent
Xue et al.

(10) Patent No.: US 11,835,215 B2
(45) Date of Patent: Dec. 5, 2023

(54) SHELF LIGHTING MECHANISM

(71) Applicants: Self Electronics Co., Ltd., Zhejiang (CN); Wanjiong Lin, Zhejiang (CN); Self Electronics USA Corporation, Norcross, GA (US)

(72) Inventors: Yuanfang Xue, Zhejiang (CN); Zuping He, Zhejiang (CN); Zhaoyong Zheng, Zhejiang (CN); Junjun Ying, Zhejiang (CN)

(73) Assignee: Self Electronics Co., Ltd., Ningbo (CN)

( * ) Notice: Subject to any disclaimer, the term of this patent is extended or adjusted under 35 U.S.C. 154(b) by 15 days.

(21) Appl. No.: 18/148,281

(22) Filed: Dec. 29, 2022

(65) Prior Publication Data

US 2023/0213179 A1 Jul. 6, 2023

(51) Int. Cl.

| | |
|---|---|
| ***F21V 33/00*** | (2006.01) |
| ***F21S 8/00*** | (2006.01) |
| ***F21S 4/28*** | (2016.01) |
| ***F21V 5/04*** | (2006.01) |
| ***F21W 131/30*** | (2006.01) |

(52) U.S. Cl.

CPC ..... *F21V 33/0012* (2013.01); *F21S 4/28* (2016.01); *F21S 8/036* (2013.01); *F21V 5/04* (2013.01); *F21W 2131/3005* (2013.01)

(58) Field of Classification Search

CPC . F21V 33/0012; F21V 5/04; F21S 4/28; F21S 8/036; F21W 2131/3005

USPC ..... 362/127, 234, 253

See application file for complete search history.

(56) References Cited

U.S. PATENT DOCUMENTS

| | | | | |
|---|---|---|---|---|
| 2011/0044030 | A1* | 2/2011 | Pichel | F21V 33/0012 362/125 |
| 2018/0058662 | A1* | 3/2018 | Breslow | F21K 9/90 |
| 2018/0142869 | A1* | 5/2018 | Pallai | F21V 23/005 |
| 2018/0180261 | A1* | 6/2018 | Xue | A47F 5/0043 |
| 2018/0180276 | A1* | 6/2018 | Zeng | A47F 3/001 |
| 2018/0182267 | A1* | 6/2018 | Zeng | F21S 4/28 |
| 2021/0156557 | A1* | 5/2021 | Zeng | F21V 5/08 |

* cited by examiner

*Primary Examiner* — Laura K Tso

(74) *Attorney, Agent, or Firm* — Wang Law Firm, Inc.

(57) ABSTRACT

A shelf lighting mechanism has a lamp arranged on the upper front of the shelf, the lamp has a light source and lens, the top of the lens has a concave space for accommodating the light source, a first irradiation part is formed on one side of the inner wall of the concave space, and the light emitting surface of the first irradiation part is arranged to guide light to irradiate the upper area of the shelf; the bottom and the other side of the inner wall of the concave space are formed with a second irradiation part, and the light emitting surface of the second irradiation part is arranged to guide the other part of the light from the light source to irradiate the lower area of the shelf. The upper and lower areas of the shelf can be illuminated simultaneously by one lamp.

10 Claims, 5 Drawing Sheets

SHELF LIGHTING MECHANISM

RELATED APPLICATION

This application claims priority to Chinese Patent Application No. CN202111664588.7, filed on Dec. 31, 2021, the entire specification of which is incorporated by reference herein.

FIELD OF THE TECHNOLOGY

The present invention relates to the field of lighting techniques, and in particular to a shelf lighting mechanism.

BACKGROUND

The mall is required to illuminate the shelf after setting the shelf. At present, many shelves are highly high, and advertisements will be set on the upper part, and commodities will be put in the lower part of the shelves. At this time, it is necessary to illuminate both the upper advertisement pictures and the lower commodities.

However, light from common light sources tends to be more diffuse, and it is difficult to simultaneously illuminate the upper and lower regions of the object. For this reason, many shopping malls use two sets of lamps to illuminate the upper and lower regions of the shelves respectively, but this arrangement is more complicated and costs more.

BRIEF SUMMARY THE TECHNOLOGY

The purpose of the present invention is to provide a shelf lighting mechanism that can simultaneously illuminate the upper and lower regions of the shelf simultaneously, and the overall arrangement is simpler and the cost is lower.

For this propose, the present invention adopts the following technical solutions:

The invention provides a shelf lighting mechanism, which includes:

a lamp, adapted to be arranged on the upper front of the shelf, the lamp includes a light source and a lens, and the top of the lens has a concave space for accommodating the light source, a first irradiation part is formed on one side of the inner wall of the concave space, and the light emitting surface of the first irradiation part is arranged toward the shelf, so as to guide part of the light from the light source to irradiate to the upper area of the shelf, and the bottom and the other side of the inner wall of the concave space are formed with a second irradiation part, and the light emitting surface of the second irradiation part is arranged toward the shelf, so as to guide the other part of the light from the light source to irradiate to the lower area of the shelf.

Optionally, the beam angle of the first irradiation part is larger than the beam angle of the second irradiation part.

Optionally, the main beam emitted by the first irradiation part is at an acute angle with the main beam emitted by the second irradiation part, and the optical path of the first irradiation part is above the optical path of the second irradiation part.

Optionally, the area irradiated by the light source on the light entry side of the second irradiation part, is larger than the area irradiated by the light source on the light entry side of the first irradiation part.

Optionally, the light emitting surface of the first irradiation part is provided with strip-shaped first light-transmitting ribs to form a first linear light structure; and/or the light emitting surface of the second irradiation part is provided with strip-shaped second light-transmitting ribs to form a second linear light structure.

Optionally, the lamp also includes a cambered light-transmitting cover, the cambered light-transmitting cover is arranged on the side of the lens toward the shelf, and the cambered light-transmitting cover is protruding toward the shelf.

Optionally, the cambered light-transmitting cover is provided with strip-shaped third light-transmitting ribs to form a third linear light structure.

Optionally, the shelf lighting mechanism further includes a connecting arm assembly, the connecting arm assembly is suitable for being arranged above the shelf, and the connecting arm assembly includes two connecting arms arranged at intervals relative to each other, the two connecting arms respectively have a first end for connecting with the shelf;

Optionally, the two connecting arms respectively extending away from the shelf with a second end, and the lamp is arranged between the second ends. Optionally, the connecting arms are all configured to be retractable.

Optionally, the lamp further includes a circuit board, the circuit board is arranged above the lens, and the circuit board is provided with sockets;

the light source is arranged between the circuit board and the lens and is electrically connected to the circuit board, and the top of the lens is provided with connecting columns, the connecting columns are plugged and fixed in the sockets.

The technical effects of the present invention:

The present invention provides a shelf lighting mechanism. The shelf lighting mechanism can be installed on the shelf through a connecting arm assembly, and then the shelf can be illuminated by the lamp installed on the transverse frame. Specifically, the lamp includes light source and lens. When the light source illuminates the shelf through the lens, the first irradiation part of the lens can guide part of the light of the light source to converge and illuminate the upper area of the shelf, and the second irradiation part of the lens can guide another part of the light source to converge and illuminate to the lower area of the shelf, so that the upper and lower parts of the shelf can be illuminated simultaneously. Compared with the existing multi-lamps arrangement, the arrangement of the shelf lighting mechanism is obviously simpler and the cost is lower.

BRIEF DESCRIPTION OF THE DRAWINGS

Embodiments of the present invention will be described below with reference to the drawings, in which.

DETAILED DESCRIPTION OF THE INVENTION

Figure 1:
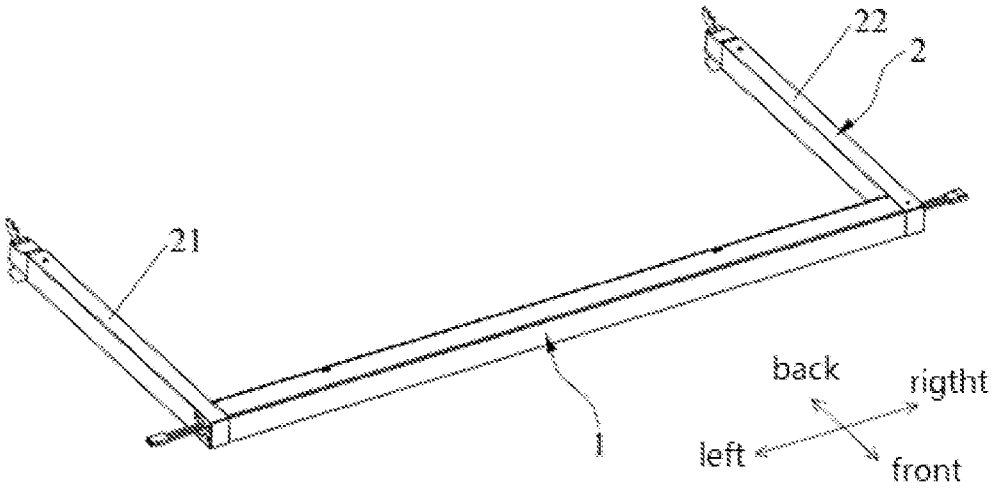
FIG. 1 is a schematic structural diagram of a shelf lighting mechanism from a first perspective provided by Embodiment 1 of the present invention.

Specific embodiments of the present invention will be described in further detail below based on the drawings. It should be understood that the description of the embodiments of the present invention herein is not intended to limit the protection scope of the present invention.

In order to make the technical problem solved, the technical solutions employed and the technical effects achieved by the present invention more clearly, the technical solutions of the present invention will be further described below with reference to the accompanying drawings.

In the description of the present invention, unless otherwise expressly specified and limited, the terms "connected", "connected" and "fixed" should be understood in a broad sense, for example, it may be a fixed connection, a detachable connection, or an integrated ; It can be a mechanical connection or an electrical connection; it can be a direct connection or an indirect connection through an intermediate medium, and it can be internal connection of two elements or the interaction relationship between the two elements. For those of ordinary skill in the art, the specific meanings of the above terms in the present invention can be understood according to specific situations.

In the description of the present embodiment, the terms "upper", "lower", "left", "right" and other positional relations are based on the orientation or positional relationship shown in the drawings, only for easy description and simplification operation. Instead of indicating or implying that the device or component must have a specific orientation, constructing and operating in a particular direction, and thus is not to be construed as limiting the invention. Furthermore, the term "first", "second" is only used to distinguish in the description and there is no special meaning.

Embodiment 1

Figure 2:
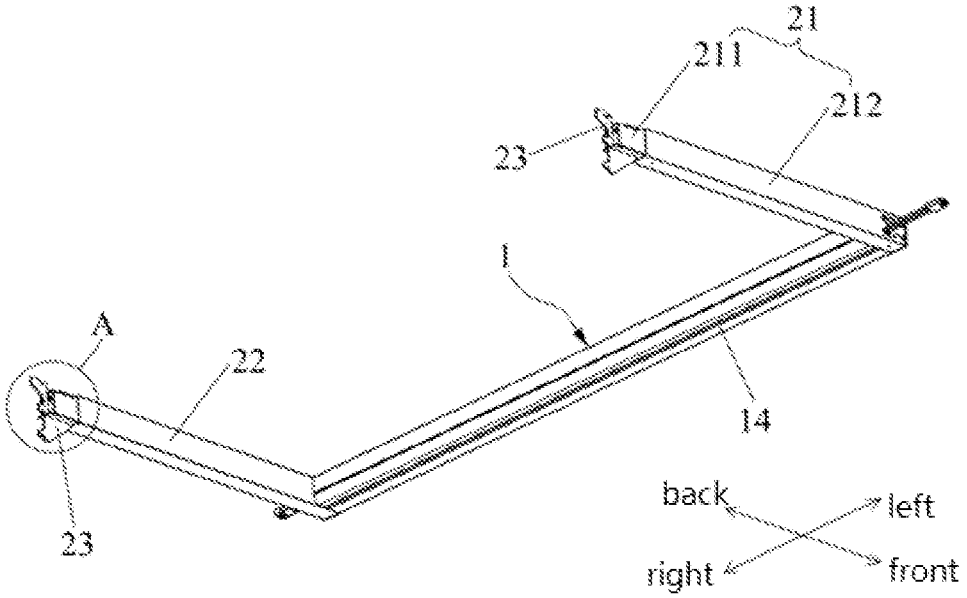
FIG. 2 is a schematic structural diagram of a shelf lighting mechanism from a second perspective provided by Embodiment 1 of the present invention.
Figure 4:
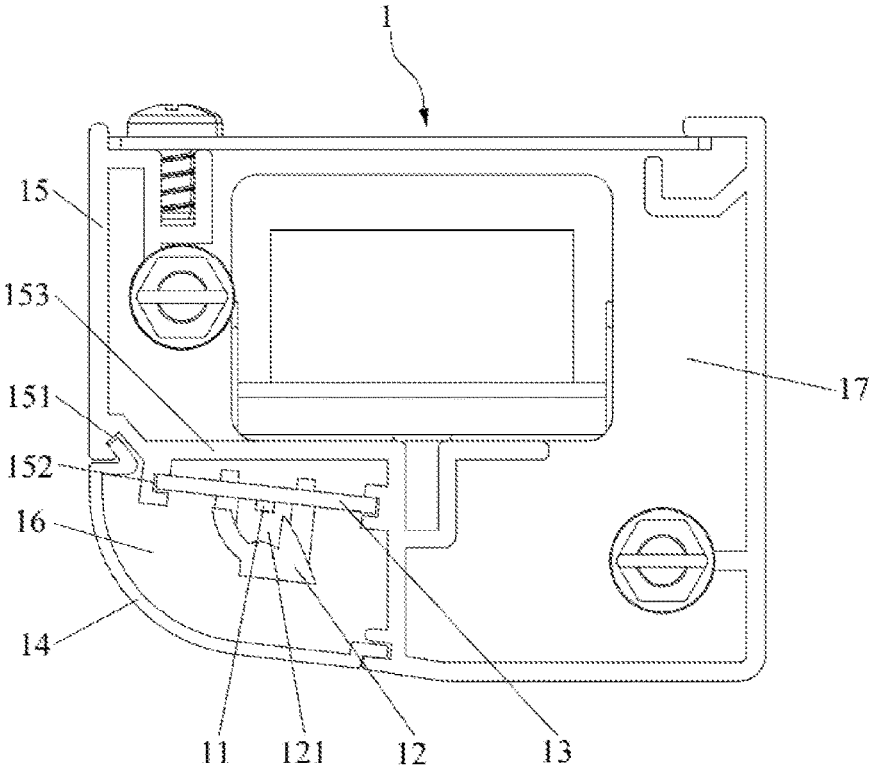
FIG. 4 is a schematic cross-sectional structure diagram of the lamp in the shelf lighting mechanism provided by Embodiment 1 of the present invention.
Figure 5:
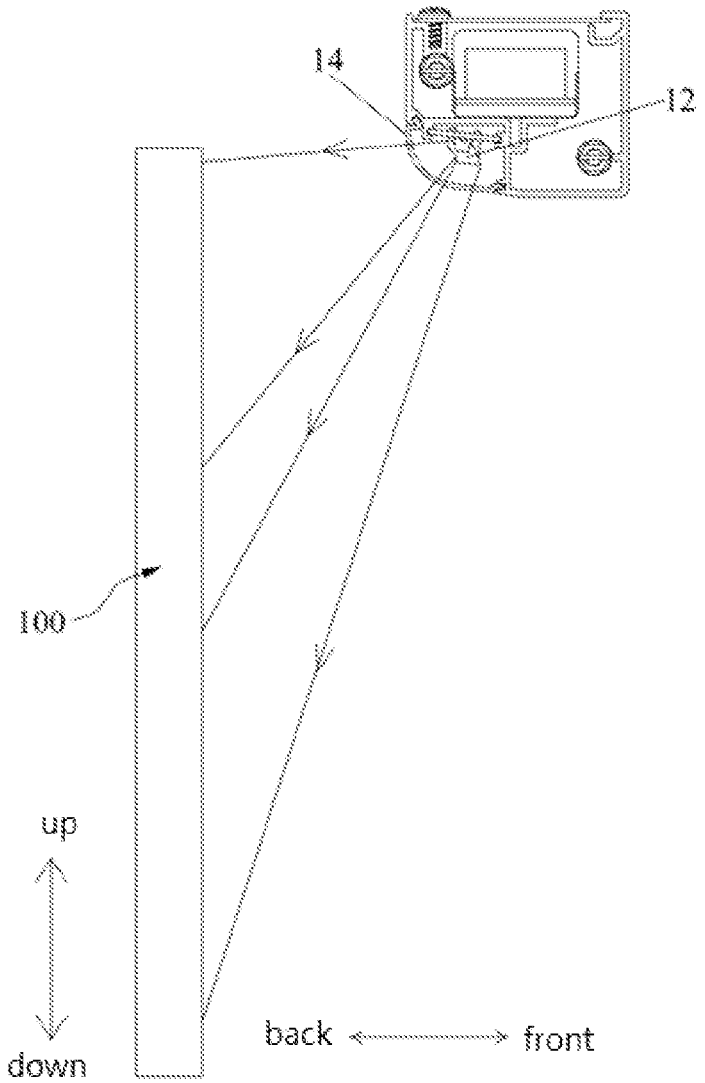
FIG. 5 is a lighting schematic diagram of the lamp in the shelf lighting mechanism provided by Embodiment 1 of the present invention.

As shown in FIGS. 1 and 2, this embodiment provides a shelf lighting mechanism including a lamp 1. Referring to FIG. 4 and FIG. 5, the lamp 1 includes a light source 11 and a lens 12 having a concave space 121 for accommodating the light source 11. A first irradiation part 122 is formed on one side of the inner wall of the concave space 121, and the light emitting surface of the first irradiation part 122 is arranged toward the shelf, so as to guide part of the light from the light source 11 to illuminate the upper area of the shelf, the bottom and the other side of the inner wall of the concave space 121 are formed with a second irradiation part 123, and light emitting surface of the second irradiation part 123 is also arranged towards the shelf to guide the other part of the light from the light source 11 to irradiate to the lower area of the shelf.

According to the above settings, when the shelf lighting mechanism is used, part of the light from the light source 11 can be concentrated and irradiated to the upper area of the object to be irradiated through the first irradiation part 122, and another part of the light from the light source 11 can be concentrated through the second irradiation part 123 then the lower area of the object is irradiated. So the upper area and the lower area of the shelf can be illuminated simultaneously by one lamp 1, without using two or more lamps, the arrangement is simpler and the cost is lower.

Figure 7:
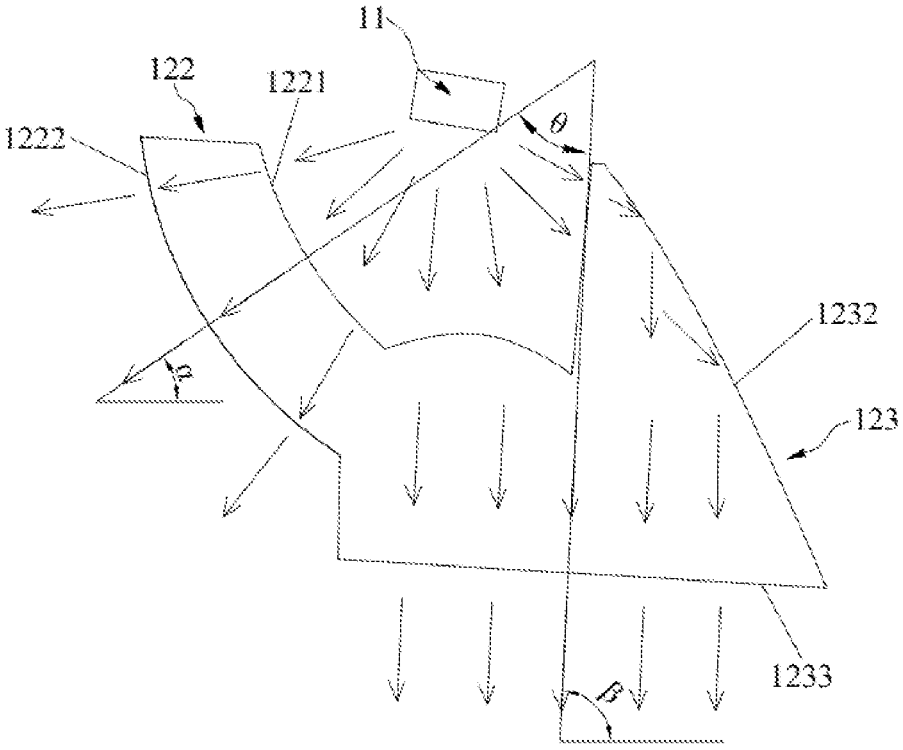
FIG. 7 is a schematic diagram of the optical path of the lens provided in Embodiment 1 of the present invention.

As for the lens 12, refer to FIG. 7, the main beam emitted by the first irradiation part 122 and the main beam emitted by the second irradiation part 123 form an acute angle, and the optical path of the first irradiation part 122 is above the optical path of the second irradiation part 123, so that the first irradiation part 122 can guide part of the light from the light source 11 to the upper area of the shelf, so that the second irradiation part 123 can guide another part of the light from the light source 11 to the lower area of the shelf. As shown in FIG. 7, the included angle between the main beam of the first irradiation part 122 and the main beam of the second irradiation part 123 is $\theta$, and $\theta$ is an acute angle.

In practice, set the orientation of the lens 12 refer to FIG. 5 and FIG. 7, and then the main beam of the first irradiation part 122 is set at an acute angle $\alpha$ with the front-rear direction of the shelf, the main beam of the second irradiation part 123 is set at an acute angle $\beta$ with the front-rear direction of the shelf, and make $\beta$ is greater than $\alpha$. As a result, the optical path of the first irradiation part 122 is placed above the second irradiation part 123.

Preferably, referring to Image 6 and FIG. 7, the beam angle of the first irradiation part 122 is larger than that of the second irradiation part 123. Through the second irradiation part 123, the light can be gathered better and thus the illumination brightness of the lower area of the object to be irradiated is improved, and the illumination brightness distribution more is made more uniform.

In this embodiment, the irradiation area by the light source 11 on the light entry side of the second irradiation part 123 is larger than the irradiating area on the light entry side of the first irradiation part 122, so that more light can enter the second irradiation part 123 and be emitted, and thus the brightness of the light emitted by the second irradiation part 123 is greater than that of the first irradiation part 122.

Further, the first irradiating part 122 and the second irradiating part 123 are integrally arranged to ensure structural strength and facilitate processing and use.

Next, the first irradiating part 122 and the second irradiating part 123 will be further introduced.

Figure 6:
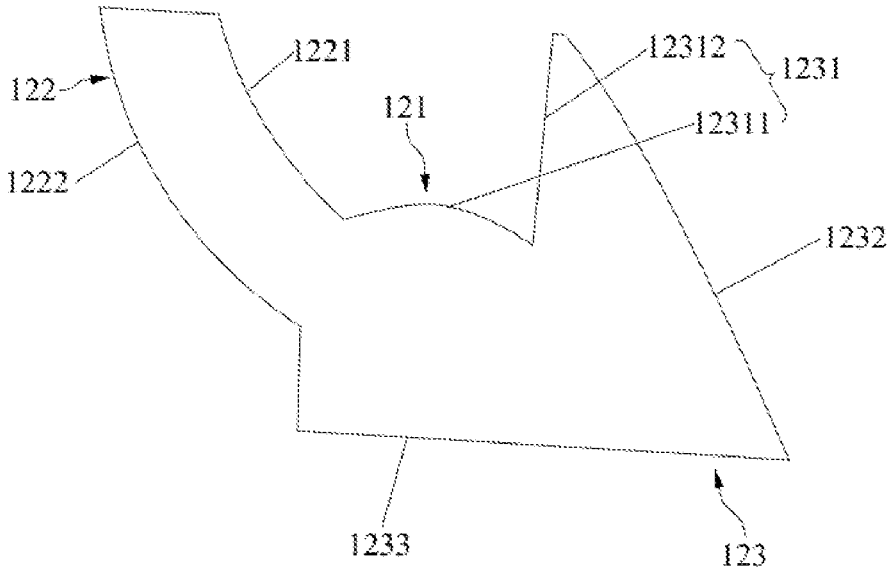
FIG. 6 is a schematic structural diagram of the lens provided in Embodiment 1 of the present invention.

As shown in FIG. 6, the first irradiation part 122 includes a first light entry surface 1221, the first light entry surface 1221 is disposed on the first side of the inner wall of the concave space 121, and the first light entry surface 1221 is a concave transparent surface. According to this, the light can be diffused through the concave transparent surface, and the light scanning area can be enlarged.

Further, the first irradiation part 122 further includes a first light emitting surface 1222, and the first light emitting surface 1222 is disposed on the side of the first light entry surface 1221 that is away from the light source 11 at a relative interval. In this embodiment, the first light emitting surface 1222 is a convex light emitting surface, and the first irradiation part 122 is a concave-convex lens as a whole. The light emitted by the first light entry surface 1221 can be aggregated again through the first light emitting surface 1222, so as to avoid excessive light divergence and make the light brightness of more uniform.

As shown in the figure, the second illumination portion 123 includes a second light entry surface 1231, a reflection surface 1232 and a second light emitting surface 1233, and the second light entry surface 1231 includes a convex transparent surface 12311 and a flat transparent surface 12312. The convex surface 12311 is disposed at the bottom of the inner wall of the concave space 121, the flat surface 12312 is disposed on the second side of the inner wall of the concave space 121, and the second light emitting surface 1233 is disposed at a relative interval on a side of the convex surface 12311 away from the light source 11. The reflective surface 1232 is disposed between the optical path of the flat transparent surface 12312 and the second light emitting surface 1233.

According to this, referring to FIG. 6 and FIG. 7, the light which is with a smaller angle to the optical axis of the light source 11 can be gathered by the convex transparent surface 12311 and then emitted by the second light emitting surface 1233; the light which is with a larger angle to the optical axis of the light source 11 can be emitted through the flat transparent surface 12312 to the reflective surface 1232 and next reflected by the reflective surface 1232 to the second light emitting surface 1233, thereby ensuring that more light can be emitted through the second light emitting surface 1233 and ensuring the illumination brightness of the lower area of the object to be irradiated.

In this embodiment, the second light emitting surface 1233 is flat, and the convex transparent surface 12311 and a part of the second light emitting surface 1233 cooperate to form a plano-convex lens structure.

The reflection surface 1232 is a paraboloid, so that more light can be directed toward the second light emitting surface 1233. Referring to the figures, the rest part of the flat transparent surface 12312, the reflecting surface 1232 and the second light emitting surface 1233 forms a triangular lens structure.

For the installation of the light source 11 and the lens 12, such as shown in FIG. 4, the lamp 1 further includes a circuit board 13 . The circuit board 13 is disposed above the lens 12 and is fixedly connected with the lamp frame 15 to avoid affecting the light emitting of the lens 12. The circuit board 13 is also provided with sockets. The light source 11 is disposed between the circuit board 13 and the lens 12 and is electrically connected to the circuit board 13. The top of the lens 12 is provided with connecting columns 124, which are plugged and fixed in the sockets to realize the installation of the lens 12.

In addition to the light source 11 and the lens 12, as shown in FIG. 4 and FIG. 5, the lamp 1 further includes an cambered light-transmitting cover 14. The cambered light-transmitting cover 14 is disposed on the side of the lens 12 that is toward the shelf, and the cambered light-transmitting cover 14 is protruding toward the shelf. According to this arrangement, the light emitted by the lens 12 can be made more uniform through the cambered light-transmitting cover 14, and the lighting effect can be further improved.

In this embodiment, referring to FIG. 4, the lamp 1 also includes a lamp frame and the cambered light-transmitting cover 14 is slidably inserted in the lamp frame 15 to facilitate installation. In this embodiment, the lamp holder 15 is provided with a first chute 151 along its own length direction, and two ends of the cambered light shield 153 form sliding rails, and the sliding rails are slidably inserted into the first chute 151.

Further, a light shield 153 is provided on the lamp frame 15, and the light shield 153 cooperates with the light-transmitting cover to define a first chamber 16 in which the lens 12 and the light source 11 are installed. As far as the overall structure of the lamp frame 15, it is a hollow frame structure. And a second chamber 17 is also provided in the lamp holder 15 independent of the first chamber 16. The second chamber 17 is used for passing wires (for connection), thereby hiding the wires.

In this embodiment, the circuit board 13 is set extending along the length direction of the lamp 1 (same with the left and right direction of the shelf), and the lamp holder 15 is also provided with a second chute 152 along its own length direction. The circuit board 13 is slidably inserted into the second chute 152 to facilitate the installation the circuit board 13.

Hereinafter, other settings of the shelf lighting mechanism are introduced.

As shown in FIG. 1 and FIG. 2, the shelf lighting mechanism further includes a connecting arm assembly 2. The connecting arm assembly 2 is used for being disposed above the shelf, and the connecting arm assembly 2 includes two connecting arms arranged oppositely and spaced apart, and the two connecting arms respectively have a first end for connecting with the shelf. The two connecting arms also respectively have a second end extending in a direction away from the shelf. The transverse frame is arranged between the second ends of the two connecting arms.

Figure 3:
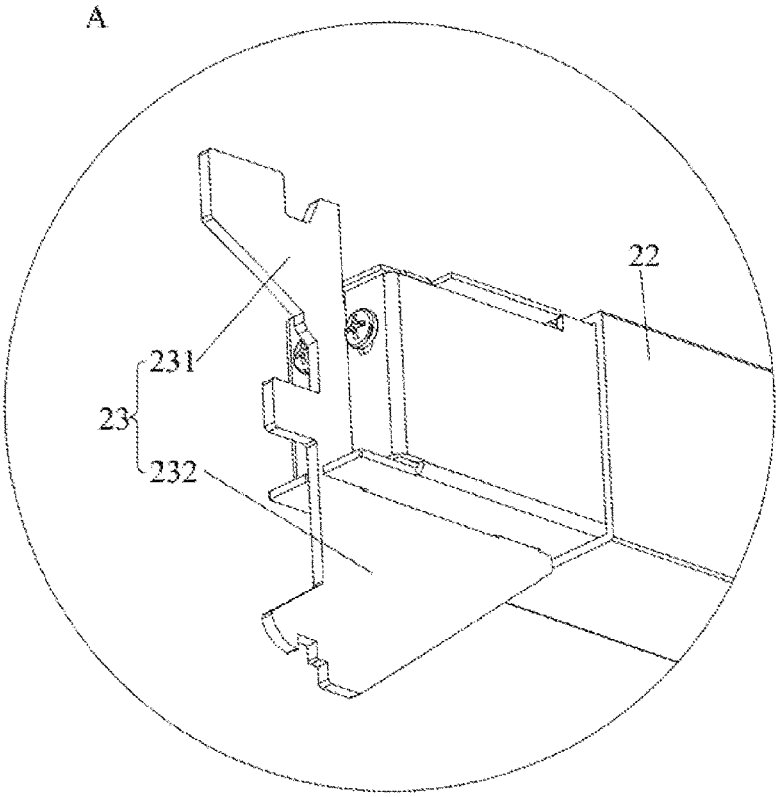
FIG. 3 is the enlarged structure diagram at area A in FIG. 2.

In terms of the connection structure of the connecting arm and the shelf, a lock hole is provided in front of the shelf. As shown in FIG. 2 and FIG. 3, the first end of the connecting arm is provided with a clip 23, and the connecting arm is clipped with the lock hole through the clip 23 to facilitate installation. Similarly, a plurality of lock holes are arranged in front of the shelf, and the plurality of lock holes are arranged in the up-down direction. In this embodiment, the clip 23 includes a first clip joint 231 and a second clip joint 232 arranged from top to bottom. The first clamping joint 231 is correspondingly clamped with a lock hole, and the second clamping joint 232 is correspondingly clamped with a lock hole lower than the above-mentioned lock hole, so that the connection between the connecting arm and the shelf can be more stable. Preferably, the second clamping joint 232 is configured as a triangular rib structure, which is supported under the connecting arm, which can further enhance the stability of the connecting structure.

In this embodiment, the two connecting arms in the connecting arm assembly 2 are the first connecting arm 21 and the second connecting arm 22, which are configured to be retractable, that is, can be extended or shortened along the front-rear direction of the shelf. Thereby, it is possible to adapt to the lighting of shelves with different depths (lengths in the front-rear direction of the shelves).

Since the two connecting arms have the same structure, only the first connecting arm 21 is taken as an example to describe its retractable arrangement. As shown in FIG. 2, the first connecting arm 21 includes a first retractable rod 211 and a second retractable rod 212. The first retractable rod 211 is fixedly connected to the end of the transverse frame, and the second retractable rod 212 is slidably inserted into the first retractable rod 211 to allow the first connecting arm 21 to expand and contract.

In this embodiment, the first retractable rod 211 is provided with a plurality of first screw holes along the length direction, the second retractable rod 212 is correspondingly provided with a plurality of second screw holes, and a fastening screw can be arranged selectively pass through a first screw hole and a second screw hole, thus to realize fixing after relative sliding between the first retractable rod 211 and the second retractable rod 212.

Embodiment 2

This embodiment provides a shelf lighting mechanism that is substantially identical to the structure of the shelf lighting mechanism in Embodiment 1, except that the lens 12 in the present embodiment is provided with light-transmitting convex ribs.

Figure 8:
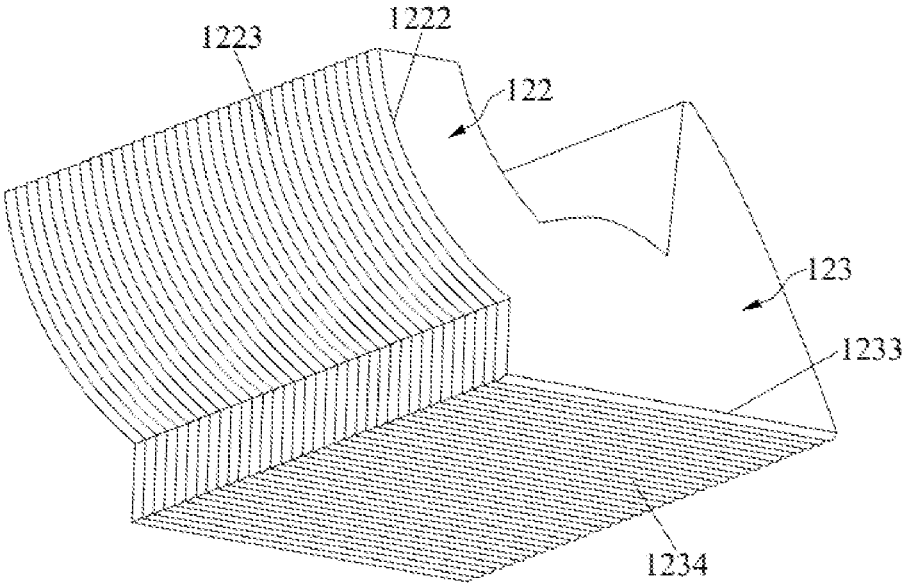
FIG. 8 is a schematic structural view of the lens provided by Embodiment 2 of the present invention.

As shown in FIG. 8, strip-shaped first light-transmitting rib 1223 is provided on the light emitting surface (i.e., first light emitting surface 1222) of the first irradiation part 122 to form a first linear light structure, and realize the sweeping of linear light source 11 and lighting effect enhanced. In the same way, the strip-like second light-transmitting rib 1234 can be provided on the light emitting surface (i.e., the second light emitting surface 1233) of the second irradiation part 123 to form a second linear light structure.

In this embodiment, the first light-transmitting rib 1223 is provided with a plurality, which are parallel to each other and connected successively in a wavy shape to achieve a better sweeping effect. The setting of second light-transmitting rib 1234 is similar to the first light transmitting rib 1223, and details are omitted herein.

Further, a plurality of first light-transmitting ribs 1223 and a plurality of second light-transmitting ribs 1234 are connected one by one, and each of which is connected together to facilitate processing.

In other embodiments, reference is made to the arrangement of the first light-transmitting rib 1223 and the second light-transmitting rib 1234, and strip-shaped third light-transmitting rib is disposed on the cambered light-transmitting cover 14 to form a third linear light structure. Further, a plurality of third translucent ribs can be provided, and a plurality of first light-transmitting ribs 1223 can be parallel to each other and sequentially connected in a wavy shape to achieve a better sweeping effect.

For specific processing, the lens 12 can be injection molded, and the light-transmitting ribs can be formed by hot pressing. Since the injection molding and hot pressures are all prior art, therefore will not be described here.

The above are only preferred embodiments of the present invention, and are not used to limit the protection scope of the present invention. Any modification, equivalent replacement or improvement within the spirit of the present invention is covered by the scope of the claims of the present invention.

What is claimed is:

1. A shelf lighting mechanism, which includes:

a lamp (1), adapted to be arranged on the upper front of the shelf, the lamp (1) includes a light source (11) and a lens (12), and the top of the lens (12) has a concave space (121) for accommodating the light source (11), a first irradiation part (122) is formed on one side of the inner wall of the concave space (121), and the light emitting surface of the first irradiation part (122) is arranged toward the shelf, so as to guide part of the light from the light source (11) to irradiate to the upper area of the shelf, and the bottom and the other side of the inner wall of the concave space (121) are formed with a second irradiation part (123), and the light emitting surface of the second irradiation part (123) is arranged toward the shelf, so as to guide the other part of the light from the light source (11) to irradiate to the lower area of the shelf.

2. The shelf lighting mechanism as claimed in claim 1, wherein, the beam angle of the first irradiation part (122) is larger than the beam angle of the second irradiation part (123).

3. The shelf lighting mechanism as claimed in claim 1, wherein, the main beam emitted by the first irradiation part (122) is at an acute angle with the main beam emitted by the second irradiation part (123), and the optical path of the first irradiation part (122) is above the optical path of the second irradiation part (123).

4. The shelf lighting mechanism as claimed in claim 1, wherein, the area, irradiated by the light source (11) on the light entry side of the second irradiation part (123), is larger than the area irradiated by the light source (11) on the light entry side of the first irradiation part (122).

5. The shelf lighting mechanism as claimed in claim 1, wherein, the light emitting surface of the first irradiation part (122) is provided with strip-shaped first light-transmitting ribs (1223) to form a first linear light structure; and the light emitting surface of the second irradiation part (123) is provided with strip-shaped second light-transmitting ribs (1234) to form a second linear light structure.

6. The shelf lighting mechanism as claimed in claim 1, wherein, the lamp (1) also includes a cambered light-transmitting cover (14), the cambered light-transmitting cover (14) is arranged on the side of the lens (12) toward the shelf, and the cambered light-transmitting cover (14) is protruding toward the shelf.

7. The shelf lighting mechanism as claimed in claim 1, wherein, the cambered light-transmitting cover (14) is provided with strip-shaped third light-transmitting ribs to form a third linear light structure.

8. The shelf lighting mechanism as claimed in claim 1, wherein, the shelf lighting mechanism further includes a connecting arm assembly (2), the connecting arm assembly (2) is suitable for being arranged above the shelf, and the connecting arm assembly (2) includes two connecting arms arranged at intervals relative to each other, the two connecting arms respectively have a first end for connecting with the shelf;

the two connecting arms respectively extending away from the shelf with a second end, and the lamp (1) is arranged between the second ends.

9. The shelf lighting mechanism as claimed in claim 1, wherein, the connecting arms are all configured to be retractable.

10. The shelf lighting mechanism as claimed in claim 1, wherein, the lamp (1) further includes a circuit board (13), the circuit board (13) is arranged above the lens (12), and the circuit board (13) is provided with sockets;

the light source (11) is arranged between the circuit board (13) and the lens (12) and is electrically connected to the circuit board (13), and the top of the lens (12) is provided with connecting columns (124), the connecting columns (124) are plugged and fixed in the sockets.

* * * * *